US008794913B2

(12) United States Patent
Nishimoto et al.

(10) Patent No.: US 8,794,913 B2
(45) Date of Patent: Aug. 5, 2014

(54) STEAM TURBINE FACILITY

(75) Inventors: Shin Nishimoto, Tokyo (JP); Yoshinori Tanaka, Tokyo (JP); Tatsuaki Fujikawa, Tokyo (JP); Ryuichi Yamamoto, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 984 days.

(21) Appl. No.: 12/674,249

(22) PCT Filed: Jul. 30, 2009

(86) PCT No.: PCT/JP2009/063908

§ 371 (c)(1),
(2), (4) Date: Apr. 15, 2010

(87) PCT Pub. No.: WO2010/018774

PCT Pub. Date: Feb. 18, 2010

(65) Prior Publication Data

US 2010/0202876 A1 Aug. 12, 2010

(30) Foreign Application Priority Data

Aug. 11, 2008 (JP) ..... 2008-207500

(51) Int. Cl.
*F04D 29/40* (2006.01)
*F01K 7/38* (2006.01)

(52) U.S. Cl.
USPC ..... 415/200; 60/653

(58) Field of Classification Search
USPC ..... 415/200; 60/660, 662, 663, 653, 677, 60/678, 679, 680
See application file for complete search history.

(56) References Cited

U.S. PATENT DOCUMENTS 7,484,926 B2 2/2009 Suga et al.
2005/0022529 A1 * 2/2005 Takahashi et al. ..... 60/653

(Continued)

FOREIGN PATENT DOCUMENTS

JP 4-171202 6/1992
JP 2000-274208 10/2000

(Continued)

OTHER PUBLICATIONS

Korean Office Action issued Dec. 8, 2011 in corresponding Korean Patent Application No. 10-2010-7001660 with English translation.

(Continued)

*Primary Examiner* — Ned Landrum
*Assistant Examiner* — Aaron Jagoda
(74) *Attorney, Agent, or Firm* — Wenderoth, Lind & Ponack, L.L.P.

(57) ABSTRACT

A steam turbine facility suppresses the possibility of vibration from occurring and prevents a drastic increase in facility cost, thereby realizing an increase in size of the facility, even if steam conditions of 650° C. or higher are adopted. In the steam turbine facility including a high-pressure turbine, an intermediate-pressure turbine, and a low-pressure turbine, the intermediate-pressure turbine is separated into a first intermediate-pressure turbine on a high-temperature and high-pressure side and a second intermediate-pressure turbine on a low-temperature and low-temperature side. At least any one of the rotors and casings of the steam-introduction-side turbines into which steam with a temperature of 650° C. or higher is introduced is formed from Ni-based alloy, and at least any one of the overall rotors and the overall casings of the turbines are constructed by joining together a plurality of rotor members or casing members by welding.

3 Claims, 3 Drawing Sheets

(56) References Cited

U.S. PATENT DOCUMENTS

| | | | | |
|---|---|---|---|---|
| 2006/0127216 | A1 | 6/2006 | Suga et al. | |
| 2008/0085192 | A1 | 4/2008 | Fukuda et al. | |
| 2008/0250790 | A1 * | 10/2008 | Imano et al. | 60/670 |

FOREIGN PATENT DOCUMENTS

| | | | | |
|---|---|---|---|---|
| JP | 2003-343210 | | 12/2003 | |
| JP | 2004-278432 | | 10/2004 | |
| JP | 4074208 | | 10/2004 | |
| JP | 2004278432 | A * | 10/2004 | F01K 13/00 |
| JP | 2005-60826 | | 3/2005 | |
| JP | 2005-344527 | | 12/2005 | |
| JP | 2006-170006 | | 6/2006 | |
| JP | 2006-307280 | | 11/2006 | |
| JP | 2008-88525 | | 4/2008 | |

OTHER PUBLICATIONS

International Preliminary Report on Patentability and Written Opinion of the International Searching Authority issued Mar. 17, 2011 in International (PCT) Application No. PCT/JP2009/063908.

Korean Notice of Allowance issued Aug. 24, 2012 in corresponding Korean Application No. 10-2010-7001660.

* cited by examiner

STEAM TURBINE FACILITY

TECHNICAL FIELD

The present invention relates to a steam turbine facility including a high-pressure turbine, an intermediate-pressure turbine, and a low-pressure turbine.

BACKGROUND ART

The three methods of atomic power, thermal power, and hydraulic power generation, are now used as main power generation methods, and from a viewpoint of resource quantity and energy density, the three power generation methods are also expected to be used as main power generation methods in the future. Especially, since thermal power generation is safe, and its utility value is high as a power generation method with a high capacity to respond to load changes, it is expected that the thermal power generation will also continue to play an important role in the power generation field in the future.

In general, a steam turbine facility, which is used in a coal-fired power station including steam turbines, is provided with a high-pressure turbine, an intermediate-pressure turbine, and a low-pressure turbine. In such a steam turbine facility, steam with a temperature in the 600° C. or lower class is used. A rotor and a casing of the high-pressure turbine or the intermediate pressure turbine, which is exposed to a high temperature, are formed from a ferrite-based material which has a thermal resistance to steam with a temperature in the 600° C. or lower class, excellent manufacturability and is economically competitive.

Recently, however, in order to reduce emissions of $CO_2$ and improve thermal efficiency a technique which adopts steam conditions in the 650° C. or 700° C. class is being demanded. Patent Document 1 has disclosed a steam turbine facility capable of operating at a high temperature in which a reheat steam condition is 650° C. or higher.

FIG. 4 is a schematic system view illustrating a conventional steam turbine facility disclosed in Patent Document 1. In the steam turbine facility 110 illustrated in FIG. 4, the intermediate-pressure turbine is separated into a first intermediate-pressure turbine 112 on a high-temperature and high-pressure side and a second intermediate-pressure turbine 114 on a low-temperature and low-pressure side. Additionally, the high-pressure turbine 116 and the second intermediate-pressure turbine 114 are integrated to form an integrated structure 122. The integrated structure 122 is connected on the same axis as the first intermediate-pressure turbine 112 on a high-temperature and high pressure side, the low-pressure turbine 124, and the generator 126.

Main steam superheated to a temperature in the 600° C. class by a boiler 132 is introduced into the high-pressure turbine 116 through a main steam pipe 134. The steam introduced into the high-pressure turbine 116 performs expansion work and is then exhausted and returned to the boiler 132 through a low-temperature reheat pipe 138. The steam returned to the boiler 132 is reheated by the boiler 132 such that the temperature thereof increases to the 700° C. class. The reheated steam is sent to the first intermediate-pressure turbine 112 through a high-temperature reheat pipe 140. A rotor of the first intermediate-pressure turbine 112 is formed from a material (austenitic heat resisting steel) capable of withstanding steam heated to a high temperature in the 700° C. class. The steam sent to the first intermediate-pressure turbine 112 performs expansion work and is then exhausted and sent to the second intermediate-pressure turbine 114 through an intermediate-pressure part connection pipe 142 in a state where the temperature thereof decreased to the 550° C. class. The steam sent to the second intermediate-pressure turbine 114 performs expansion work and is then exhausted and introduced to the low-pressure turbine 124 through a crossover pipe 144. The steam introduced into the low-pressure turbine 124 performs expansion work and is then exhausted and sent to a condenser 128. The steam sent to the condenser 128 is condensed by the condenser 128, and is then returned to the boiler 132 in a state where the pressure thereof is raised by a water feed pump 130. The generator 126 is rotationally driven by the expansion work of the respective turbines to generate power.

In such a steam turbine facility, the intermediate-pressure turbine is divided, and only the first intermediate-pressure turbine 112 is formed from a material capable of withstanding steam with a temperature of 650° C. or higher. Therefore, a steam condition of 650° C. or higher may be adopted, and the amount of the material capable of withstanding steam with a temperature of 650° C. or higher used may be reduced. Therefore, it is possible to reduce the manufacturing costs of the entire facility.

In the technique disclosed in Patent Document 1, however, when a steam turbine facility with large capacity is considered, the facility illustrated in FIG. 4 is difficult to implement. When such a material as Ni-based alloy capable of withstanding steam with a temperature of 650° C. or higher is used to form the first intermediate-pressure turbine 112, it is difficult to manufacture a turbine rotor or casing weighing 10*t* or more in terms of the limitation of material manufacturing, and it is impossible to manufacture a large-sized turbine rotor or casing.

Therefore, as illustrated in FIG. 5, the first intermediate-pressure turbine may be further divided into primary and secondary first intermediate-pressure turbines 112 and 113. In this case, however, the number of casings increases, and thus the number of buildings or pipes increases. Therefore, the manufacturing costs of the facility inevitably increases. Additionally, as the number of shafts (divided turbines) increases, it is highly likely that vibrations occur.

Additionally, a ferrite-based material may be used instead of using the Ni-based alloy. In this case, however, a large amount of cooling steam needs to be introduced into the casings. As a result, the internal efficiency of the turbines decreases.

PRIOR ART DOCUMENT

Patent Document

[Patent Document 1] Japanese Patent No. 407-4208

SUMMARY OF THE INVENTION

Accordingly, the invention was made in view of the problems of the conventional technique, and the object thereof is to provide a steam turbine facility capable of suppressing the possibility of vibration occurrence and a drastic increase in facility costs, thereby realizing an increase in size of the facility, even if a steam condition of 650° C. or higher is adopted.

In order to solve the above problems, the invention provides a steam turbine facility including a high-pressure turbine, an intermediate-pressure turbine, and a low-pressure turbine. The intermediate-pressure turbine is separated into a first intermediate-pressure turbine on a high-temperature and high-pressure side and a second intermediate-pressure turbine on a low-temperature and low-temperature side, at least any one of the rotors and casings of the steam-introduction-side turbines into which steam with a temperature of 650° C. or higher is introduced is formed from Ni-based alloy, and at least any one of the overall rotors and the overall casings of the turbines are constructed by joining together a plurality of rotor members or casing members by welding.

In the steam turbine facility, at least any one of the rotors and the casings (i.e., at least any one of the steam-introduction-side rotors and casings of the high-pressure turbine and the first intermediate-pressure turbine) of the (steam-introduction-side) turbines into which steam with a temperature of 650° C. or higher is introduced is formed from Ni-based alloy, and at least any one of the overall rotors and the overall casings of the turbines are constructed by joining together a plurality of rotor members or casing members by welding. Therefore, it is possible to increase the size of the rotors or the casings without an effect caused by the material manufacturing limitation of Ni-based alloy. Even under steam conditions in which steam with a temperature of 650° C. or higher is introduced, it is possible to increase the size of the facility without increasing the numbers of casings and rotors (divided turbines).

The high-pressure turbine, the first intermediate-pressure turbine, the second intermediate-pressure turbine, and the low-pressure turbine may be connected together on the same axis. At least any one of the rotor and the casing of the first intermediate-pressure turbine into which the steam with a temperature of 650° C. or higher is introduced or at least any one of the rotors and the casings of the first intermediate-pressure turbine and the high-pressure turbine into which steam with a temperature of 650° C. or higher is introduced may be formed from Ni-based alloy. At least any one of the overall rotors and the overall casings of the turbines may be constructed by joining together a plurality of rotor members or casing members by welding.

Additionally, steam with a temperature of 650° C. or higher may be introduced into the first intermediate-pressure turbine. The high-pressure turbine and the second intermediate-pressure turbine may be integrated so as to be connected to the low-pressure turbine on the same axis which is different from that of the first intermediate-pressure turbine. The first intermediate-pressure turbine may be arranged at a position closer to the boiler than the connection structure of the high-pressure turbine, the second intermediate-pressure turbine, the boiler superheating the steam introduced into the high-pressure turbine and the intermediate-pressure turbine.

As the first intermediate-pressure turbine into which steam with a temperature of 650° C. or higher is introduced is arranged close to the boiler, it is possible to shorten the pipe connecting the boiler to the first intermediate-pressure turbine into which the steam with a temperature of 650° C. or higher is introduced. Accordingly, it is possible to reduce the amount of material used in the pipe. Since the steam with a temperature of 650° C. or higher passes through the pipe connecting the boiler to the first intermediate-pressure turbine into which the steam with a temperature of 650° C. or higher is introduced, it is necessary to use a Ni-based alloy that is a high-grade material. However, since the amount of material used is reduced by shortening the pipe, it is possible to reduce the manufacturing costs of the entire facility.

Additionally, the high-pressure turbine, the second intermediate-pressure turbine, and the low-pressure turbine may be integrated to form an integrated structure. In this case, since the numbers of casings and rotors are reduced, it is possible to reduce the facility costs.

Additionally, steam with a temperature of 650° C. or higher may be introduced into the high-pressure turbine and the first intermediate-pressure turbine. The high-pressure turbine and the first intermediate-pressure turbine may be integrated. The second intermediate-pressure turbine and the low-pressure turbine may be connected together on the same axis which is different from that of the integrated structure of the high-pressure turbine and the first intermediate-pressure turbine. The integrated structure of the high-pressure turbine and the first intermediate-pressure turbine may be arranged at a position closer to the boiler than the connection structure of the second intermediate-pressure turbine and the low-pressure turbine, the boiler superheating the steam introduced into the high-pressure turbine and the intermediate-pressure turbine.

As the high-pressure turbine and the first intermediate-pressure turbine into which steam with a temperature of 650° C. or higher is introduced are arranged close to the boiler, it is possible to shorten a pipe connecting the boiler to the high-pressure turbine and a pipe connecting the boiler to the first intermediate-pressure turbine. Accordingly, it is possible to reduce the amount of material used in the pipes. Since the steam with a temperature of 650° C. or higher passes through the pipe connecting the boiler to the high-pressure turbine and the pipe connecting the boiler to the first intermediate-pressure turbine, it is necessary to use a high-grade Ni-based alloy material. However, since the amount of material used is reduced by shortening the pipes, it is possible to reduce the manufacturing costs of the entire facility.

The second intermediate-pressure turbine and the low-pressure turbine may be integrated to form an integrated structure. In this case, since the numbers of casings and rotors are reduced, it is possible to reduce the facility costs.

According to the invention, even if a steam condition in the 650° C. class or the 700° C. class is adopted, it is possible to suppress the possibility of vibration occurrence and a drastic increase in facility costs. Additionally, it is possible to increase the size of the steam turbine facility.

DETAILED DESCRIPTION OF THE INVENTION

Preferred examples of the invention will be illustratively described below in detail with reference to the drawings. Here, the dimensions, materials, shapes, relative arrangements, etc. of component parts described in this example are not meant to limit the scope of the invention, but are merely simple explanatory examples, as long as there is no specific description of limitations.

EXAMPLE 1

Figure 1:
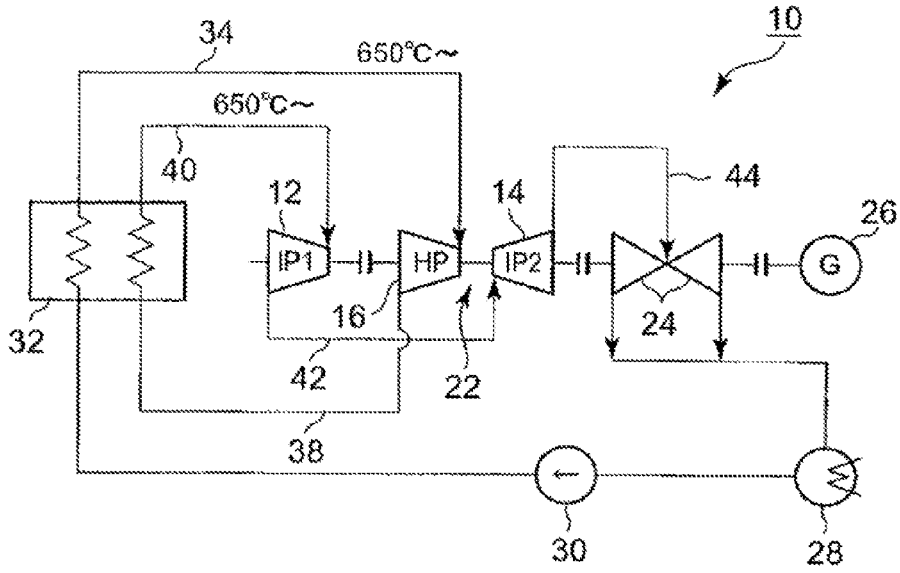
FIG. 1 is a view illustrating the configuration of a steam turbine power generation facility according to Example 1 of the invention.

FIG. 1 is a view illustrating the configuration of a steam turbine power generation facility according to Example 1 of the invention.

As illustrated in FIG. 1, the steam turbine power generation facility according to Example 1 of the invention will be described.

The steam turbine power generation facility 10 illustrated in FIG. 1 includes a high-pressure turbine 16, an intermediate-pressure turbine separated into two as will be described later, a low-pressure turbine 24, a generator 26, a condenser 28, and a boiler 32 as main components. The intermediate-pressure turbine is separated into a first intermediate-pressure turbine 12 on a high-temperature and high-pressure side and a second intermediate-pressure turbine 14 on a low-temperature and low-pressure side, and the high-pressure turbine 16 and the second intermediate-pressure turbine 14 are integrated to form an integrated structure 22.

Additionally, the first intermediate-pressure turbine 12, the integrated structure 22, the low-pressure turbine 24, and the generator 26 are connected together on the same axis.

At least any one of a steam-introduction-side rotor and a casing of the first intermediate-pressure turbine 12 is formed from Ni-based alloy, and at least any one of the overall rotors and the overall casings of the turbines are constructed by joining together a plurality of rotor members or casing members by welding.

Main steam superheated to a temperature of 650° C. or higher by the boiler 32 is introduced into the high-pressure turbine 16 through a main steam pipe 34. The steam introduced into the high-pressure turbine 16 performs expansion work and is then exhausted and returned to the boiler 32 through a low-temperature reheat pipe 38. The steam returned to the boiler 32 is reheated by the boiler 32 such that the temperature thereof increases to 650° C. or higher. The reheated steam is sent to the first intermediate-pressure turbine 12 through a high-temperature reheat pipe 40. The sent steam performs expansion work in the first intermediate-pressure turbine 12 and is then exhausted in a state where the temperature thereof has decreased to 550° C. class. The exhausted steam is sent to the second intermediate-pressure turbine 14 through an intermediate-pressure part connection pipe 42. The steam sent to the second intermediate-pressure turbine 14 performs expansion work and is then exhausted and sent to the low-pressure turbine 24 through a crossover pipe 44. The steam sent to the low-pressure turbine 24 performs expansion work and is then exhausted and sent to the condenser 28. The steam sent to the condenser 28 is condensed by the condenser 28, and is then returned to the boiler 32 in a state where the pressure thereof is raised by a water feed pump 30. The generator 26 is rotationally driven by the expansion work of the respective turbines to generate power.

According to the above-described steam turbine power generation facility 10 of Example 1 of the invention, at least any one of the rotor and the casing of the (steam-introduction-side) first intermediate-pressure turbine into which steam with a temperature of 650° C. or higher is introduced is formed from Ni-based alloy, and at least any one of the overall rotors and the overall casings of the turbines are constructed by joining together a plurality of rotor members or casing members by welding. Therefore, it is possible to increase the size of the facility without increasing the numbers of casings, rotors, and blade stages.

Additionally, the high-pressure turbine 16, the second intermediate-pressure turbine 14, and the low-pressure turbine 24 may be integrated to form an integrated structure (not shown). In this case, since the numbers of casings and rotors are reduced, it is possible to reduce the facility costs.

EXAMPLE 2

Figure 2:
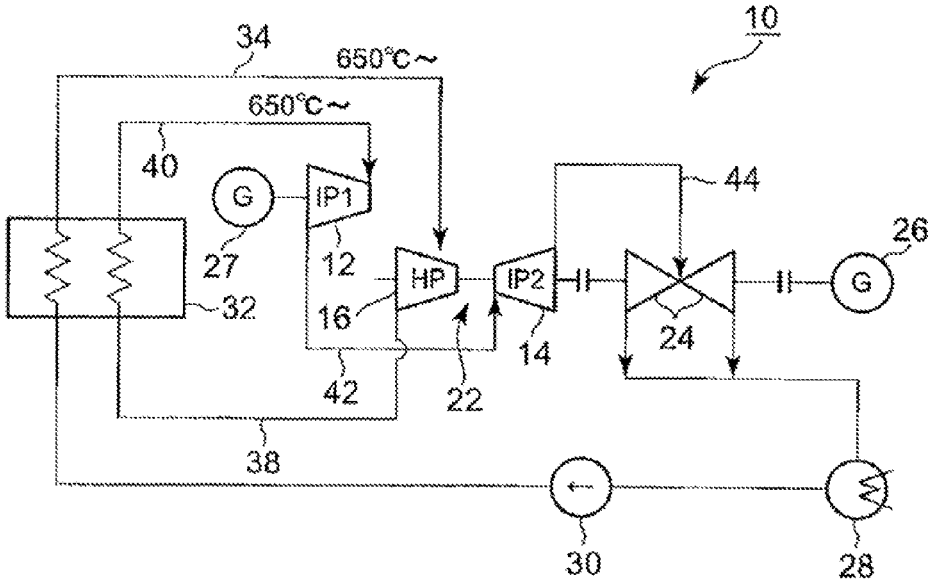
FIG. 2 is a view illustrating the configuration of a steam turbine power generation facility according to Example 2 of the invention.

FIG. 2 is a view illustrating the configuration of a steam turbine power generation facility according to Example 2 of the invention.

As illustrated in FIG. 2, the steam turbine power generation facility according to Example 2 of the invention will be described.

The steam turbine power generation facility 10 illustrated in FIG. 2 includes a high-pressure turbine 16, an intermediate-pressure turbine separated into two as will be describer later, a low-pressure turbine 24, generators 26 and 27, a condenser 28, and a boiler 32 as main components. The intermediate-pressure turbine is separated into a first intermediate-pressure turbine 12 on a high-temperature and high-pressure side and a second intermediate-pressure turbine 14 on a low-temperature and low-pressure side, and the high-pressure turbine 16 and the second intermediate-pressure turbine 14 are integrated to form an integrated structure 22.

Additionally, the integrated structure 22, the low-pressure turbine 24, and the generator 26 are connected together on the same axis so as to form a connection structure, and the first intermediate-pressure turbine 12 and the generator 27 are connected together on the same axis so as to be arranged at a position closer to the boiler 32 than the connection structure. The closer to the boiler 32 the first intermediate-pressure turbine 12 is, the better.

Additionally, at least any one of a steam-introduction-side rotor and a casing of the first intermediate-pressure turbine 12 is formed from Ni-based alloy, and at least any one of the overall rotors and the overall casings of the turbines are constructed by joining together a plurality of rotor members or casing members by welding.

Main steam superheated to a temperature of 650° C. or higher by the boiler 32 is introduced into the high-pressure turbine 16 through a main steam pipe 34. The steam introduced into the high-pressure turbine 16 performs expansion work and is then exhausted and returned to the boiler 32 through a low-temperature reheat pipe 38. The steam returned to the boiler 32 is reheated by the boiler 32 such that the temperature thereof increases to 650° C. or higher. The reheated steam is sent to the first intermediate-pressure turbine 12 through a high-temperature reheat pipe 40. The sent steam performs expansion work in the first intermediate-pressure turbine 12 and is then exhausted in a state where the temperature thereof has decreased to the 550° C. class. The exhausted steam is sent to the second intermediate-pressure turbine 14 through an intermediate-pressure part connection pipe 42. The steam sent to the second intermediate-pressure turbine 14 performs expansion work and is then exhausted and sent to the low-pressure turbine 24 through a crossover pipe 44. The steam sent to the low-pressure turbine 24 performs expansion work and is then exhausted and sent to the condenser 28. The steam sent to the condenser 28 is condensed by the condenser 28, and is then returned to the boiler 32 in a state where the pressure thereof is raised by a water feed pump 30. The generators 26 and 27 are rotationally driven by the expansion work of the respective turbines to generate power.

According to the above-described steam turbine power generation facility 10 of Example 2 of the invention, at least any one of the rotor and the casing of the (steam-introduction-side) first intermediate-pressure turbine into which steam with a temperature of 650° C. or higher is introduced is formed from Ni-based alloy, and at least any one of the overall rotors and the overall casings of the turbines are constructed by joining together a plurality of rotor members or casing members by welding. Therefore, it is possible to increase the size of the facility without increasing the numbers of casings, rotors, and blade stages.

Moreover, as the first intermediate-pressure turbine 12 into which the steam with a temperature of 650° C. or higher is introduced is arranged closer to the boiler 32, it is possible to shorten the pipe connecting the boiler 32 to the first intermediate-pressure turbine 12. Accordingly, it is possible to reduce the amount of material used in the pipe. Since steam with a temperature of 650° C. or higher passes through the pipe connecting the boiler 32 to the first intermediate-pressure turbine 12, it is necessary to manufacture the pipe with high-grade Ni-based alloy material. However, since the amount of material used is reduced by shortening the pipe, it is possible to reduce the manufacturing costs of the entire facility.

Additionally, the high-pressure turbine 16, the second intermediate-pressure turbine 14, and the low-pressure turbine 24 may be integrated to form an integrated structure (not shown). In this case, since the numbers of casings and rotors are reduced, it is possible to reduce the facility costs.

EXAMPLE 3

Figure 3:
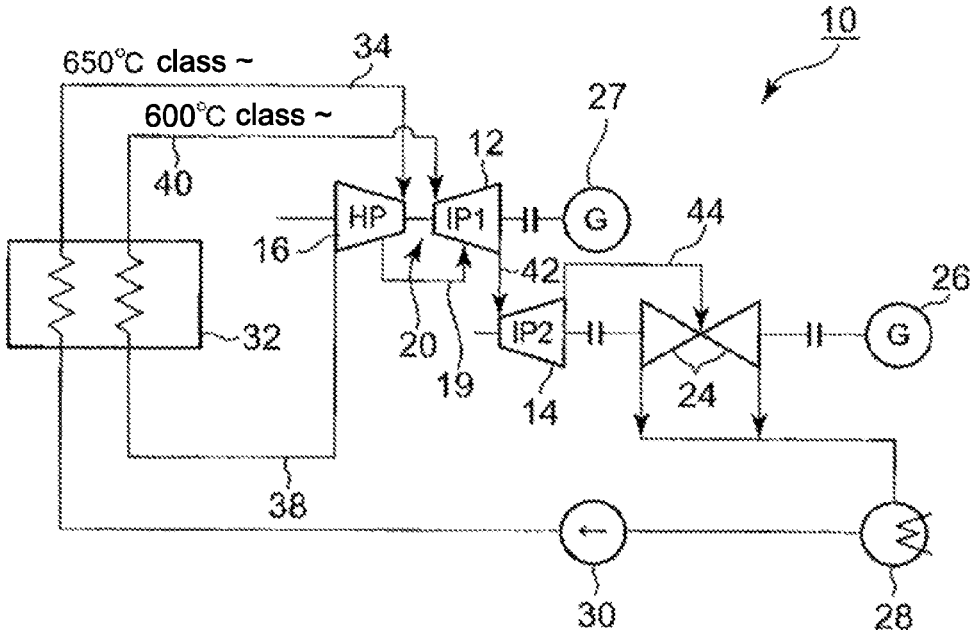
FIG. 3 is a view illustrating the configuration of a steam turbine power generation facility according to Example 3 of the invention.
Figure 4:
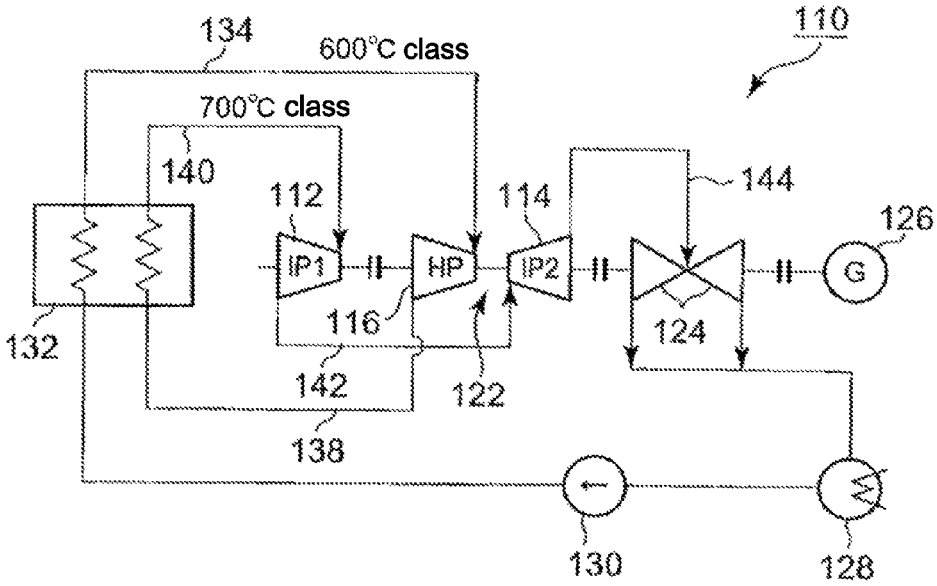
FIG. 4 PRIOR ART
FIG. 4 is a view illustrating the configuration of a conventional steam turbine facility.
Figure 5:
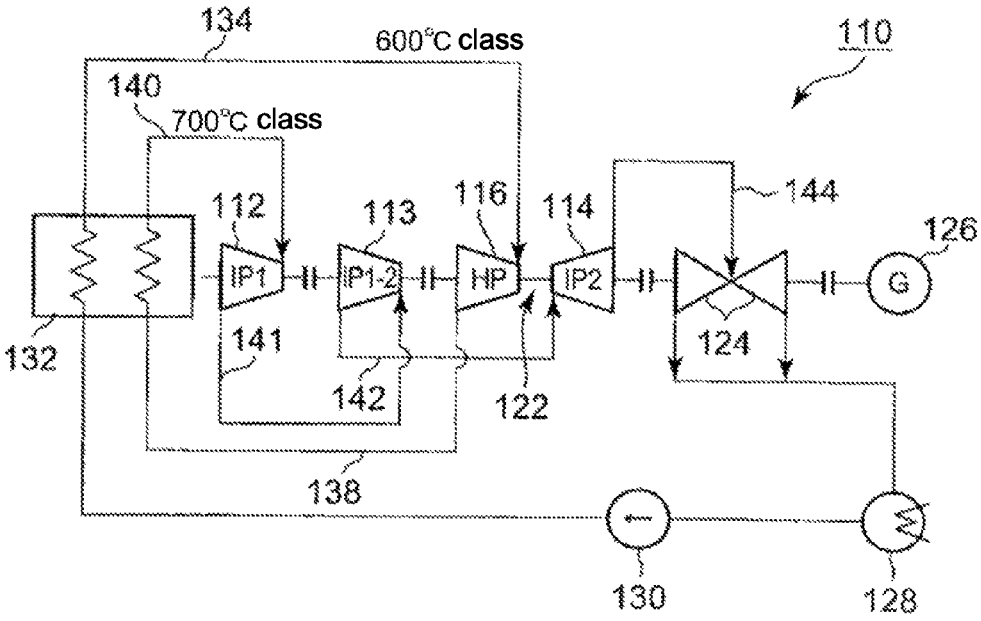
FIG. 5 is a view illustrating the configuration of another conventional steam turbine facility.

FIG. 3 is a view illustrating the configuration of a steam turbine power generation facility according to Example 3 of the invention.

The steam turbine power generation facility 10 illustrated in FIG. 3 is constructed by partially changing the configuration of the steam turbine power generation facility according to Example 2 of the invention, which is illustrated in FIG. 2. The following descriptions will be focused on different components from those of Example 2 of the invention.

In the steam turbine power generation facility 10 illustrated in FIG. 3, the high-pressure turbine 16 and the first intermediate-pressure turbine 12 are integrated to form an integrated structure 20. The second intermediate-pressure turbine 14, the low-pressure turbine 24 and the generator 26 are connected together on the same axis so as to form a connection structure, and the integrated structure 20 and the generator 27 are connected together on the same axis so as to be arranged at a position closer to the boiler 32 than the connection structure. The closer to the boiler 32 the integrated structure 20 is, the better.

Additionally, at least any one of the steam-introduction-side rotors and casings of the high-pressure turbine 16 and the first intermediate-pressure turbine 12 are formed from Ni-based alloy, and at least any one of the overall rotors and the overall casings of the turbines are constructed by joining together a plurality of rotor members or casing members by welding.

Additionally, steam with a temperature of 650° C. or higher is introduced into both the high-pressure turbine 16 and the first intermediate-pressure turbine 12.

According to the above-described steam turbine power generation facility 10 of Example 3 of the invention, at least any one of the steam-introduction-side rotors and casings of the high-pressure turbine 16 and the first intermediate-pressure turbine 12, into which the steam with a temperature of 650° C. or higher is introduced, are formed from Ni-based alloy, and at least any one of the overall rotors and the overall casings of the turbines are constructed by joining together a plurality of rotor members or casing members by welding. Therefore, it is possible to increase the size of the facility without increasing the numbers of casings, rotors, and blade stages.

Additionally, in the steam turbine power generation facility, steam with a temperature of 650° C. or higher is introduced into the high-pressure turbine 16 and the first intermediate-pressure turbine 12, and steam with a temperature of less than 650° C. is introduced into the second intermediate-pressure turbine 14. Additionally, the integrated structure 20 is formed by integrated the high-pressure turbine 16 and the first intermediate-pressure turbine 12 using at least any one of the rotors and the casings into which the steam with a temperature of 650° C. or higher is introduced, and which are formed from Ni-based alloy and have at least any one of the overall rotors and the overall casings of the turbines constructed by joining a plurality of rotor members or casing members through welding. Therefore, since the amount of high-grade Ni-based alloy material used is reduced, it is possible to suppress an increase in facility costs.

Moreover, as the high-pressure turbine 16 and the first intermediate-pressure turbine 12 into which the steam with a temperature of 650° C. or higher is introduced are arranged closer to the boiler 32, it is possible to shorten a pipe connecting the boiler 32 to the high-pressure turbine 16 and a pipe connecting the boiler 32 to the first intermediate-pressure turbine 12. Accordingly, it is possible to reduce the amount of material used in the pipes. Since the steam with a temperature of 650° C. or higher passes through the pipe connecting the boiler 32 to the first intermediate-pressure turbine 12, it is necessary to manufacture the pipe with high-grade Ni-based alloy material. However, since the amount of material used is reduced by shortening the pipe, it is possible to drastically reduce the manufacturing costs of the entire facility.

Additionally, the second intermediate-pressure turbine 14 and the low-pressure turbine 24 may be integrated to form an integrated structure (not shown). Accordingly, since the numbers of casings and rotors are reduced, it is possible to reduce the facility costs.

Industrial Applicability

According to the examples of the invention, even if a steam condition in the 650° C. class or the 700° C. class is adopted, it is possible to suppress the possibility of vibration occurrence and a drastic increase in facility costs. Additionally, it is possible to increase the size of the steam turbine facility.

The invention claimed is:

1. A steam turbine facility comprising a high-pressure turbine, an intermediate-pressure turbine, and a low-pressure turbine, wherein the intermediate-pressure turbine is separated into a first intermediate-pressure turbine on a high-temperature and high-pressure side and a second intermediate-pressure turbine on a low-temperature and low-pressure side, wherein the high-pressure turbine, the second intermediate-pressure turbine, and the low-pressure turbine are integrated to form an integrated structure having a casing and a rotor in common, wherein the integrated structure and the first intermediate-pressure turbine are connected together on a same axis or are arranged on different axes from each other, wherein at least any one of rotors and casings of steam-introduction-side turbines into which steam with a temperature of 650° C. or higher is introduced is formed from Ni-based alloy, and wherein at least any one of overall rotors and overall casings of turbines are constructed by joining together a plurality of rotor members or casing members by welding.

2. The steam turbine facility according to claim 1, wherein the integrated structure and the first intermediate-pressure turbine are connected together on the same axis, and wherein at least any one of a rotor and a casing of the first intermediate-pressure turbine on a steam introduction side into which steam with a temperature of 650° C. or higher is introduced or at least any one of rotors and casings of the first intermediate-pressure turbine and the high-pressure turbine on a steam introduction side into which steam with a temperature of 650° C. or higher is introduced is formed from Ni-based alloy.

3. The steam turbine facility according to claim 1, wherein steam with a temperature of 650° C. or higher is introduced into the first intermediate-pressure turbine, wherein the integrated structure and the first intermediate-pressure turbine are arranged on the different axes from each other, and wherein the first intermediate-pressure turbine is arranged at a position closer to a boiler than the integrated structure, the boiler superheating steam introduced into the high-pressure turbine and the intermediate-pressure turbine.

* * * * *